United States Patent [19]

Matsumoto et al.

[11] Patent Number: 4,572,685

[45] **Date of Patent: * Feb. 25, 1986**

[54] DOT PRINTER

[75] Inventors: Yoshikane Matsumoto; Tsuneki Kobayashi; Makoto Kurosawa; Minoru Seino, all of Ibaraki, Japan

[73] Assignee: Hitachi Koki Co., Ltd., Japan

[ * ] Notice: The portion of the term of this patent subsequent to Dec. 20, 2000 has been disclaimed.

[21] Appl. No.: 502,354

[22] Filed: Jun. 8, 1983

Related U.S. Application Data

[63] Continuation-in-part of Ser. No. 367,518, Apr. 12, 1982, Pat. No. 4,421,430.

[51] Int. Cl.[4] ..... B41J 25/28

[52] U.S. Cl. ..... 400/320; 101/93.04; 400/121; 400/352

[58] Field of Search ..... 400/121, 124, 320, 322, 400/328, 352; 101/93.04, 93.05, 93.09; 74/567

[56] References Cited

U.S. PATENT DOCUMENTS

| | | | |
|---|---|---|---|
| 1,912,535 | 6/1933 | Mitchell | 74/567 X |
| 3,941,051 | 3/1976 | Barrus et al. | 400/121 X |
| 4,421,430 | 12/1983 | Matsumoto et al. | 400/352 X |

FOREIGN PATENT DOCUMENTS

| | | | |
|---|---|---|---|
| 71580 | 5/1980 | Japan | 101/93.09 |
| 154063 | 11/1981 | Japan | 101/93.05 |

*Primary Examiner*—Paul T. Sewell
*Attorney, Agent, or Firm*—Sughrue, Mion, Zinn, Macpeak and Seas

[57] ABSTRACT

A printing mechanism is provided with a counterbalanced hammer bank such that the hammer bank and a counterweight are oppositely reciprocated by a pair of cams mounted on a vertically oriented cam shaft. Vibration of the printer even at high speed can be eliminated by completely dynamically balancing the system.

7 Claims, 10 Drawing Figures

DOT PRINTER

BACKGROUND OF THE INVENTION

This invention is a continuation-in-part of U.S. patent application Ser. No. 367,518, filed Apr. 12, 1982.

This invention relates to dot printers in which dot printing is carried out using printing hammers, for example, those disclosed in U.S. Pat. No. 3,941,051 or printing wires, for example, as disclosed in U.S. Pat. No. 3,999,644. In particular, it relates to a mechanism which reciprocates a hammer bank incorporating such printing hammers or printing wires and drive means therefor along a printing line.

In the case of a printer in which the printing hammers or wires are driven while such a hammer bank is reciprocated along a printing line, the weight of the hammer bank is very large and the speed of movement of the hammer bank is high. Accordingly, the printer itself is subject to significant vibration. In order to decrease printer vibration, a technique has been employed in which the hammer bank and a counterweight having a weight equal to the weight of the hammer bank are reciprocated in opposite directions.

The hammer bank and the counterweight are provided on both sides of an elliptic cam. The hammer bank and the counterweight are each moved by the cam in one direction and by a spring in the opposite direction. Accordingly, the drive source, such as an electric motor, must be large, because it must move both the hammer bank and the counterweight against the elastic force of the springs. This tendency is increased as the speed of the hammer bank, i.e., the speed of rotation of the cam, is increased to increase the printing speed. If a large capacity drive motor of large size is employed as the drive source, problems as to installation space and cooling means arise, and it becomes impossible to miniaturize the printer.

SUMMARY OF THE INVENTION

An object of this invention is to eliminate the above-described difficulties accompanying conventional dot printers, to make it possible for a small capacity motor to reciprocate the hammer bank and the counterweight, and to provide a high printing speed without increasing the size of the dot printer.

This invention has been developed from the recognition that, if the hammer bank is reciprocated in association with one cam and the counterweight is reciprocated in association with a second cam, then the hammer bank and the counterweight can be reciprocated without using springs. The cams, sliders reciprocated by the cams and the hammer bank and the counterweight which are coupled to the sliders are combined according to the invention, wherein the cam shaft extends in the vertical direction. Thus the reduction of the inertia couple found in prior systems is accomplished. Also a more compact device is achieved.

BRIEF DESCRIPTION OF THE DRAWINGS

In FIG. 2, a lower slider is shown displaced from its actual position, as conductive to an understanding of the invention;

DETAILED DESCRIPTION OF THE PREFERRED EMBODIMENTS

Figure 1:
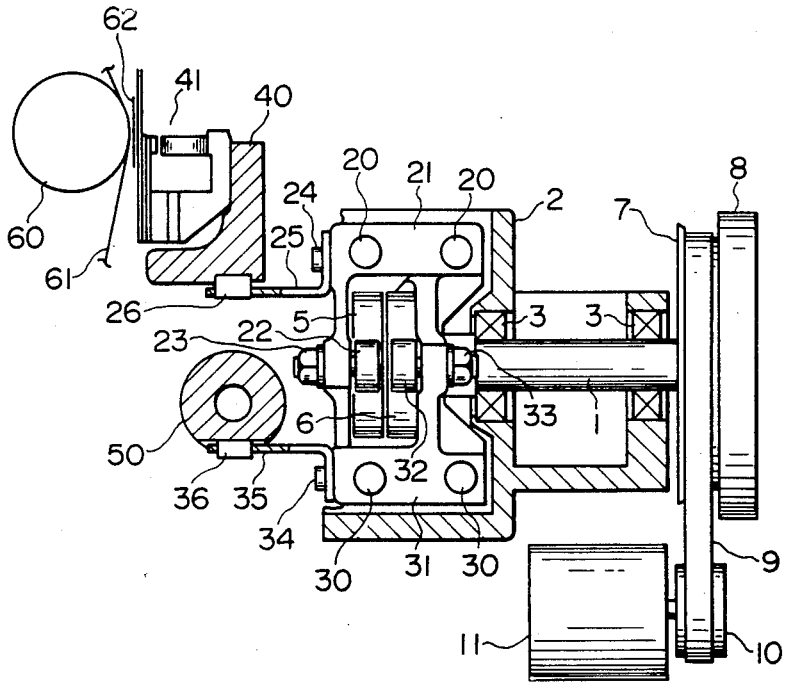
FIG. 1 is a cross-sectional view showing the essential components of a first embodiment of the invention.
Figure 2:
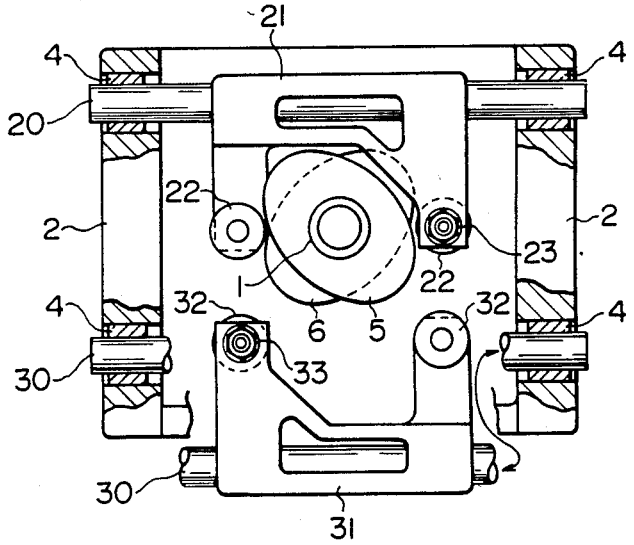
FIG. 2 is a side view of the device as viewed from the side of the hammer bank in FIG. 1.

Referring now to FIGS. 1 and 2, cam shaft 1 is rotatably supported on a frame 2 with the aid of bearings 3, and is driven through a driven pulley 7, a belt 9 and a drive pulley 10 by a motor 11. A flywheel 8 is coupled to the rear end of the cam shaft 1 to minimize variations in rotation of the cam shaft 1. A pair of cams 5 and 6 are mounted on the front end portion of the cam shaft 1 in such a manner that the major diameters thereof are substantially orthogonal to one another.

Substantially C-shaped sliders 21 and 31 are mounted respectively on two guide shafts 20 and 30 which are supported through linear slide bearings 4 on the frame 2 and are provided respectively above and below the cam shaft 1, so that the sliders 21 and 31 can be reciprocated perpendicular to the cam shaft 1. Each of the sliders 21 and 31 has two arms which extend on either side of the cam shaft 1 and perpendicularly to the cam shaft 1. Rollers 22 are rotatably mounted on the ends of the two arms of the slider 21 with nuts 23, respectively. Similarly, rollers 32 are rotatably mounted on the ends of the two arms of the slider 31 by nuts 33. The arms of the upper slider 21 extend downwardly so that the pair of rollers 22 are in contact with the rear cam surface of the first cam 5 and the front cam surface of the second cam 6, respectively. On the other hand, the arms of the lower slider 31 extend outwardly so that the pair of rollers 32 are respectively in contact with the front cam surface of the first cam 5 and the rear cam surface of the second cam 6.

L-shaped holders 25 and 35 are secured to the front surfaces of the sliders 21 and 31 with bolts 24 and 34, respectively. The holders 25 and 35 have arms extending forwardly on which a hammer bank 40 and a counterweight 50 are mounted through blocks 26 and 36, respectively. The hammer bank 40 includes a plurality of printing hammers arranged in a printing line and drive means for driving the printing hammers, the hammers and drive means being generally indicated at 41. The drive means are made up of permanent magnets, yokes, and releasing coils, etc. The drive means may be, for example, that disclosed in detail in U.S. Pat. No. 3,941,051. The weight of the counterweight 50 is selected so that it is substantially equal to the total weight of the hammer bank 40, including the printing hammers and the drive means which are generally indicated at 41.

A platen 60 is provided along the printing line so that it confronts the printing hammers through a printing sheet 61 and an ink ribbon 62.

The rollers 22 and 32 are in contact with the cam surfaces of the cams 5 and 6 as described above. Therefore, as the cam shaft 1 rotates, the sliders 21 and 31 are reciprocated in opposite directions and horizontally in FIG. 2. Accordingly, the hammer bank 40 and the counterweight 50 are also reciprocated in opposite directions and perpendicular to the surface of the drawing in FIG. 1. In this operation, the hammer bank 40 and the counterweight 50 are dynamically in balance with one another, because they are equal in both weight and acceleration. Thus, the printer will not vibrate.

In the above-described embodiment, the rollers 22 and 32 are made rotatable in order to minimize the wear of the rollers 22 and 32 and the contacting cam surfaces of the cams 5 and 6, and to thereby reduce the drive torque of the motor 11. However, in a case where it is unnecessary to take wear into account, the rollers 22 and 32 may be fixed elements.

As is apparent from the above description, according to the first embodiment of the invention, the hammer bank and the counterweight are reciprocated by two cams and return springs are not necessary. Therefore, the arrangement around the cam is considerably simple, and the printer assembly can be minimized. Furthermore, the motor 11 may be of small capacity, which contributes to the miniaturization of the printer. Thus, a high speed printer can be readily provided. Since the configuration of the cams can be selected as desired, the hammer bank and the counterweight can be reciprocated with any desired speed characteristic.

As described above relative to the first embodiment, the hammer bank 40 and the counterweight 50 carry out reciprocations which differ by a 180° phase, so that the reaction forces caused by the accelerations are cancelled out. This tends to prevent vibrations of the printer. However, the reaction forces cancelled out are only those in the direction of acceleration of the hammer bank 40 and the counterweight 50 and a couple due to the reaction forces described below cannot be cancelled out in the first embodiment.

Figure 3:
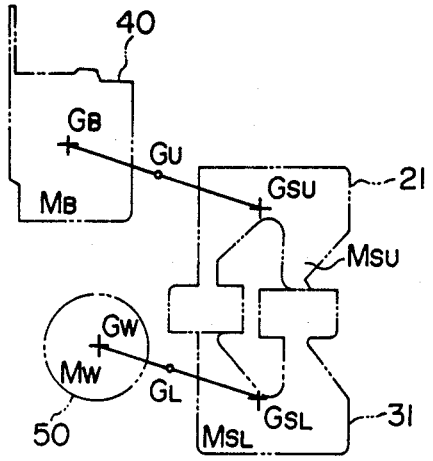
FIG. 3 is a front view of the first embodiment, illustrating the arrangement of the weights of the reciprocating members of FIG. 1.

FIG. 3 is an explanatory diagram which shows the arrangement of the weights or masses of the reciprocating members in FIG. 1. In FIG. 3, reference characters $G_B$ and $M_B$ designate the center of gravity and the weight of the hammer bank 40 including the printing hammers and the drive means (41), respectively; $G_W$ and $M_W$, the center of gravity and the weight of the counterweight 50, respectively; $G_{SU}$ and $M_{SU}$, the center of gravity and the weight of the slider 21, respectively; and $G_{SL}$ and $M_{SL}$, the center of gravity and the weight of the slider 31. Because of the counterbalance mechanism, $(M_B+M_{SU})=(M_W+M_{SL})$.

Further in FIG. 3, reference character $G_U$ designates the center of gravity of an assembly including the hammer bank 40, the slider 21 and the holder 25; and $G_L$, the center of gravity of an assembly including the counterweight 50, the slider 31 and the holder 35. As is apparent from FIG. 3, the center of gravity $G_U$ is spaced from the center of gravity $G_L$. As the hammer bank 40 and the counterweight 50 are accelerated in opposite directions and perpendicular to the surface of the drawing as was described before, a couple M is formed which may be represented by the following expression:

$$M = \alpha\,(M_B + M_{SU}) \cdot \overline{G_U G_L}$$

where, $\alpha$ is the acceleration of the hammer bank 40 and the counterweight 50.

The printer is additionally vibrated by the couple M in association with the reciprocation period of the hammer bank 40. The acceleration $\alpha$ is proportional to the square of the reciprocation speed. Therefore, in the case of a relatively low speed printer, by reducing the weight of the reciprocating members and making the distance $G_U G_L$ between the gravity centers as short as possible, the couple M can be decreased, so that the vibration is decreased. On the other hand, in the case of a high speed printer, it is substantially impossible to suitably decrease the couple M by merely reducing the distance between the gravity centers, because the speed of reciprocation of the hammer bank 40 is high and accordingly, the acceleration is large.

Figure 4:
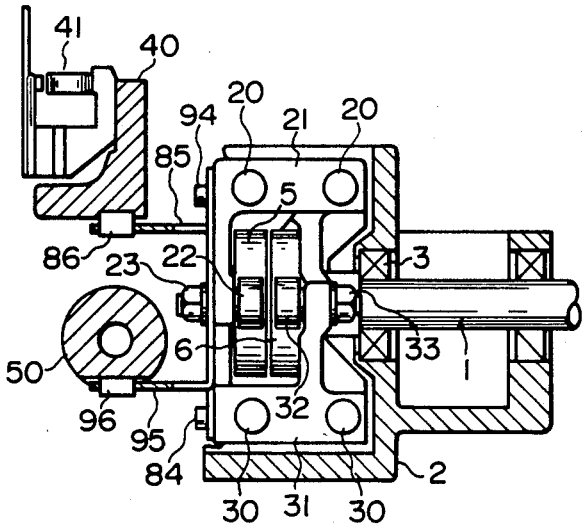
FIG. 4 is a cross-sectional view of the essential components of a second embodiment of the invention.

In view of the foregoing, the second embodiment shown in FIG. 4 is designed so that the couple M is made substantially equal to zero. In this embodiment, a hammer bank 40 is mounted through a block 86 on a holder 85 which is secured to a lower slider 31 with bolts 84. A counterweight 50 is mounted through a block 96 on a holder 95 which is secured to an upper slider 21 with bolts 94.

Figure 5:
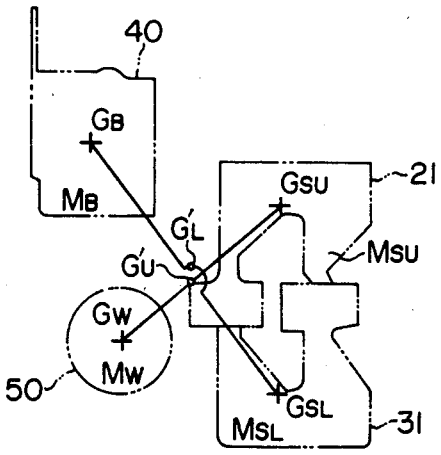
FIG. 5 is a front view of the second embodiment, illustrating the arrangement of the weights of the reciprocating members of FIG. 4.

FIG. 5 is an explanatory diagram which shows the arrangement of the weights of the reciprocating members in the second embodiment shown in FIG. 4. A line connecting the center of gravity $G_B$ of the hammer bank 40 to the center of gravity $G_{SL}$ of the slider 31 and a line connecting the center of gravity $G_W$ of the counterweight 50 to the center of gravity $G_{SU}$ of the slider 21 cross each other substantially at the mid points thereof in a vertical plane. Accordingly, as is apparent from FIG. 5, the center of gravity $G_L'$ of an assembly including the hammer bank 40, the slider 31 and the holder 85 is very close to the center of gravity $G_U'$ of an assembly including the counterweight 50, the slider 21 and the holder 95, and the distance $G_U G_L$ between the gravity centers is substantially zeroed, so that the value of the couple M is substantially equal to zero.

That is, in the arrangement of FIG. 4, not only can the reaction forces in the direction of acceleration be cancelled out, but also the couple due to the reaction forces can be eliminated. Since this is effectuated even when the speed of reciprocation of the hammer bank is increased, the printer can be stably operated at any speed.

In either of the above-described embodiments, the counterbalance is obtained by accelerating the counterweight 50 in a direction opposite to the direction of acceleration of the hammer bank 40. However, the counterbalance may be obtained as follows. For instance, as disclosed by U.S. patent application Ser. No. 291,719, two hammer banks which are accelerated to reciprocate in opposite directions may be arranged perpendicular to the printing line with a predetermined distance therebetween. One of the hammer banks is driven as the above-described counterweight 50. This technique is advantageous in that the printing speed can be increased since two hammer banks are employed. Employing this technique in the present system comprises a third embodiment of the invention.

Figure 6:
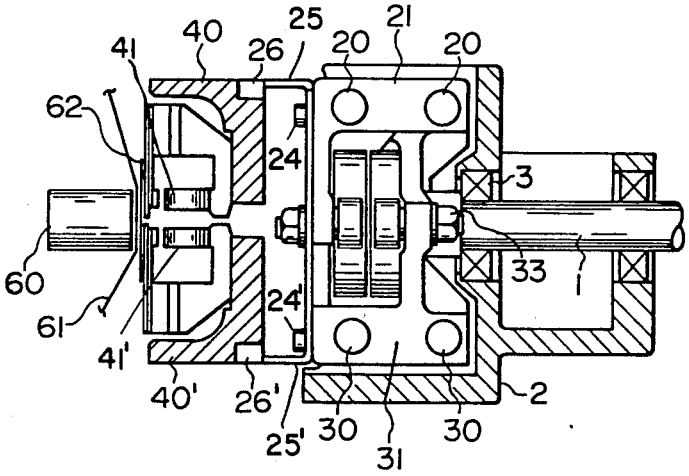
FIG. 6 is a cross-sectional view showing a third embodiment of the invention.

Referring now to FIG. 6, a third preferred embodiment of the invention is illustrated. In this embodiment, those elements previously identified have been given like numbers. As shown in FIG. 6, the counterweight 50 is eliminated. In its place, a second hammer bank 40' having drive means 41' is mounted through block 26' onto an L-shaped holder 25'. The holder 25' is secured to slider 21 by bolts 24. Given this orientation, the second hammer bank 40' functions as a counterweight in the system. In order to achieve the dynamic balance, shown in FIG. 5, the two banks are separated by a predetermined distance perpendicular to the printing line.

According to the embodiments shown in FIGS. 1 through 6, the cam shaft 1 extends in horizontal direction, and cams 5 and 6 of oval shape are mounted on the shaft 1. Further, the hammer bank 40 performs reciprocating movement in association with the rotation of two cams 5 and 6. For example, in FIG. 2, leftward movement of the slider 21 is provided by the cam 5 while rightward movement of the slider is provided by the cam 6. The same is true with respect to the counterweight 50.

Fourth and fifth embodiments are illustrated in FIGS. 7–10. According to the fourth and fifth embodiments, a cam shaft 1' extends in vertical direction (see FIG. 8), and two cams 5*a*, 6*a* are mounted on the cam shaft 1'. Further, the hammer bank 40 is reciprocated in association with a single cam 5*a*, and the counterweight 50 is reciprocated in opposite direction in association with another single cam 6*a*.

Figure 7:
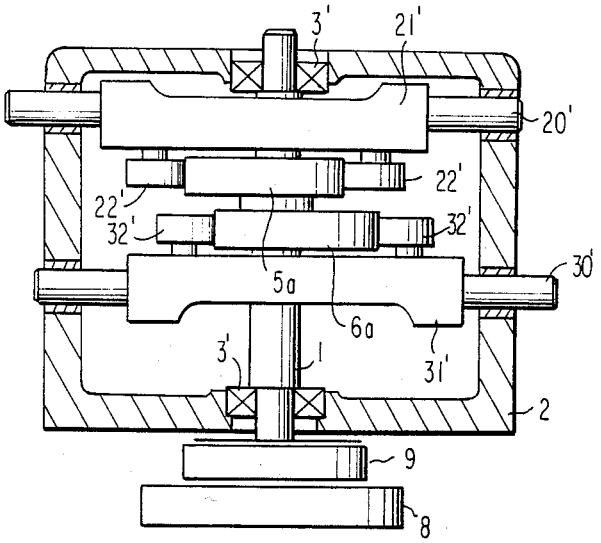
FIG. 7 is a side view from the side of the hammer bank according to a fourth embodiment of the present invention.
Figure 8:
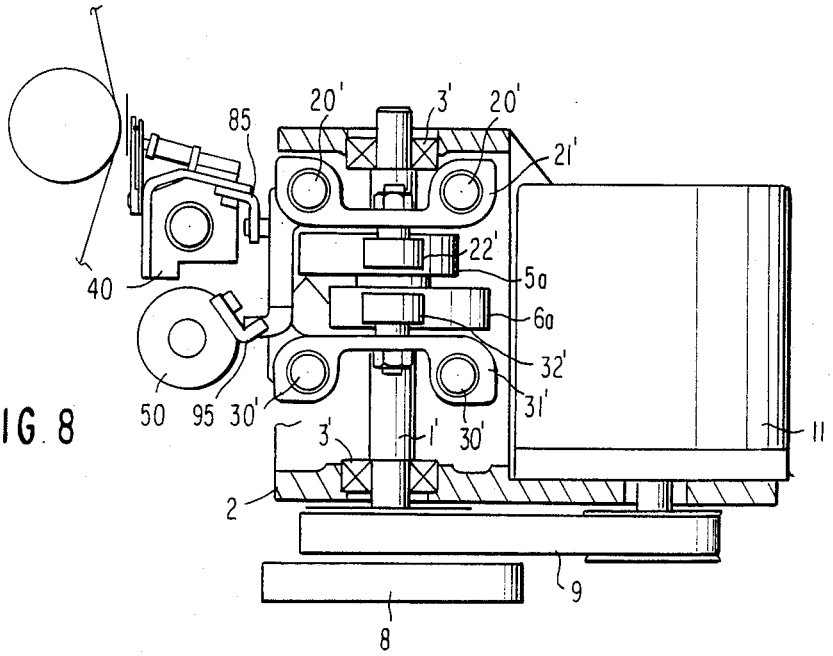
FIG. 8 is a cross-sectional view of the essential components of the fourth embodiment.
Figure 9:
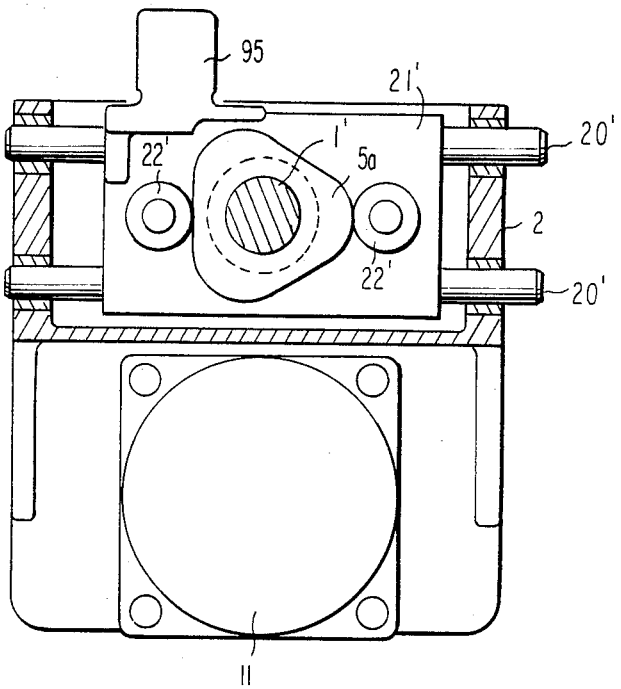
FIG. 9 is a top plan view showing the essential components according to the fourth embodiment.

According to the fourth embodiment illustrated in FIGS. 7–9, a slider 21' is slidably disposed on a pair of guide shafts 20' and a slider 31' is slidably disposed on a pair of guide shafts 30'. These guide shafts 20', 30' extend in horizontal direction. In FIG. 8, the upper slider 21' is connected to the counterweight 50 through a holder 95, and the lower slider 31' is connected to the hammer bank 40 through a holder 85.

As shown in FIG. 7, the upper slider 21' rotatably supports a pair of rollers 22', and the lower slider 31' rotatably supports a pair of rollers 32'. The rollers 22' are in contact with the upper cam 5*a*, and the roller 32' are in contact with the lower cam 6*a*. The shape of the cam 5*a* is shown in FIG. 9. The cam 5*a*, 6*a* have generally triangular shape, and are angularly offset by 60°. In FIG. 7, when the apex portion of the cam 5*a* is brought into contact with the left roller 22', the slider 21' is at the most leftward position, while the right side roller 22' is in contact with the base portion of the cam 5*a*. In this case, the apex portion of lower cam 6*a* urges the right side roller 32' to the right to displace the slider 31' since the cams 5*a*, 6*a* are offset by 60°.

According to the fourth embodiment, the cross line is obtainable as in the case of the embodiment shown in FIG. 5, so that the value of the couple M is minimized. Further, since the cam shaft 1' extends in vertical direction, a compact device results in horizontal direction. Furthermore, in the first through third embodiments, hammer bank 40 (or weight 50) is operated by two cams 5, 6, so that high dimensional accuracy is required in two cams. However, in the fourth embodiment, since hamer bank 40 (or weight 50) is operated by a single cam, high dimensional accuracy is not strictly required. Moreover, a single rotation of the cam 5*a* or 6*a* provides a three-time reciprocation of the counterweight 50 or hammer bank 40, whereas in the first through third embodiments, a single rotation of the cam provides two reciprocations of the bank or weight.

Figure 10:
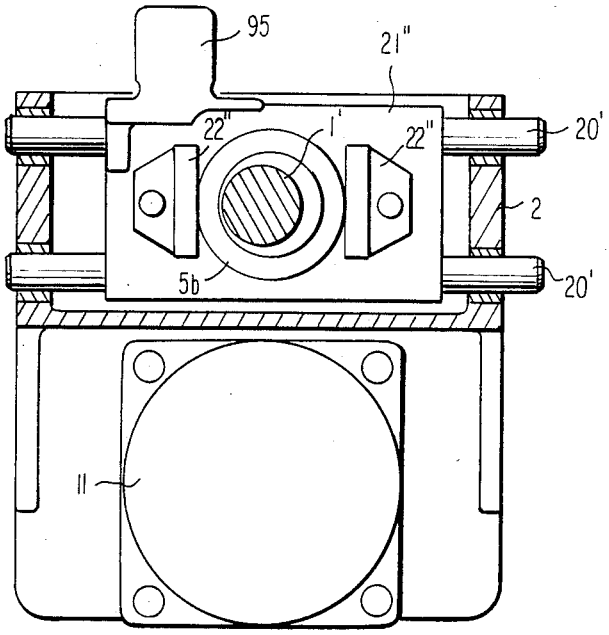
FIG. 10 is a top plan view showing the essential components according to the fifth embodiment of the present invention.

FIG. 10 illustrates a fifth embodiment of the present invention wherein cam shaft 1' vertically extends and the "cross line" arrangement as seen in FIG. 5 is provided as in the case of the fourth embodiment. Further, the upper slider 21'' is moved by a single upper cam 5*b*, and the lower slider 31'' (not shown in FIG. 10) is moved by a single lower cam 6*b* (not shown in FIG. 10) as in the case of the fourth embodiment.

However, in the fifth embodiment, instead of employing rotatable rollers 22', 32', a pair of cam followers 22'' are fixedly secured to the slider 21'' to maintain surface contact with an eccentrically mounted circular cam 5*b*. The same is true with respect to the lower slider 31''. According to the fifth embodiment, a single rotation of the cam 5*b* (or 6*b*) provides single reciprocation of the weight 50 (or hammer bank 40), and since the cam surface is circular, it is unnecessary to employ the rotatable rollers 22', 32 of the foregoing embodiment. Of course, in order to move the bank and weight in opposite directions, the eccentric cams 5*b* and 6*b* are angularly offset by 180°.

While this invention has been described in detail relative to the five preferred embodiments, it is apparent that other modifications of the invention may be practiced without departing from the scope thereof. For example, as in the case of FIG. 6, the counterweight may be eliminated and a second hammer bank used in its place.

In the embodiments of FIGS. 7–10, the reduction of the couple M occurs consistent with the force diagram of FIG. 5. That is, the hammer bank and the counterweight are coupled to the sliders via arms 85 and 95 in such a manner that a line connecting the center of gravity of the hammer bank 40 to the center of gravity of its associated slider and a line connecting the center of gravity of the counterweight 50 to the center of gravity of its associated slider cross each other. Thus, the advantages of this invention are maintained.

We claim:

1. A dot printer, comprising:

a rotatable vertically mounted cam shaft, and means for driving said cam shaft;

first and second cams mounted on said cam shaft in a manner such that the major diameters thereof are orthogonal with one another;

a pair of first and second sliders reciprocable in opposite directions and perpendicular to said cam shaft, said first slider having means in contact with cam surfaces of said cam shaft and said second slider having means in contact with cam surfaces of said second cam on opposite sides of said cam shaft;

hammer bank means including a plurality of printing hammers, and a hammer bank coupled to said first slider so that said hammer bank is reciprocated along a printing line; and counterweight means coupled to said second slider so that said counterweight means is reciprocated in a direction opposite the direction of reciprocation of said hammer bank, said counterweight means having a weight which is substantially equal to that of said hammer bank, wherein said hammer bank and said counterweight are coupled to said pair of sliders in a manner such that a line connecting the center of gravity of said hammer bank to the center of gravity of one of said pair of sliders and a line connecting the center of gravity of said counterweight to the center of gravity of the other slider cross one another.

2. A dot printer as claimed in claim 1, wherein said means in contact with said cam surfaces comprises a pair of rollers for contacting said cam surfaces, each said slider having a pair of said rollers.

3. A dot printer as claimed in claim 1, wherein said means in contact with said cam surfaces comprises a pair of cam followers for contacting said cam surfaces, each slider having a pair of cam followers.

4. A dot printer as claimed in claim 1, wherein said hammer bank including drive means for driving said printing hammers.

5. A dot printer as claimed in claim 1, wherein each cam has a generally triangular outside surface shape and said first and second cams are offset from each other by 60°.

6. A dot printer as claimed in claim 3, wherein each cam has a generally circular outside surface shape and is eccentrically mounted on said cam shaft and said first and second cams are offset from each other by 180°.

7. A dot printer, comprising:

a rotatable vertically mounted cam shaft, and means for driving said cam shaft;

first and second cams mounted on said cam shaft in a manner such that the major diameters thereof are orthogonal with one another;

a pair of first and second sliders reciprocable in opposite directions and perpendicular to said cam shaft, said first slider having means in contact with cam surfaces of said cam shaft and said second slider having means in contact with cam surfaces of said second cam on opposite sides of said cam shaft;

hammer bank means including a plurality of printing hammers, and a hammer bank coupled to said first slider so that said hammer bank is reciprocated along a printing line; and counterweight means coupled to said second slider so that said counterweight means is reciprocated in a direction opposite the direction of reciprocation of said hammer bank, wherein said hammer bank and said counterweight are coupled to said pair of sliders in a manner such that a line connecting the center of gravity of said hammer bank to the center of gravity of one of said pair of sliders and a line connecting the center of gravity of said counterweight to the center of gravity of the other slider cross one another.

* * * * *